US006905203B2

(12) United States Patent
Kremers et al.

(10) Patent No.: US 6,905,203 B2
(45) Date of Patent: Jun. 14, 2005

(54) METHOD OF PRINTING A RECEIVING MATERIAL WITH HOT MELT INK AND AN INKJET PRINTER SUITABLE FOR APPLYING SUCH A METHOD

(75) Inventors: Martinus Antonius Kremers, Ottersum (NL); Maurice Hendrikus Hubertinus Thijssen, Deurne (NL); Berby Marga Gerarda Weitenauer, Venlo (NL)

(73) Assignee: Océ-Technologies B.V., MA Venlo (NL)

( * ) Notice: Subject to any disclaimer, the term of this patent is extended or adjusted under 35 U.S.C. 154(b) by 152 days.

(21) Appl. No.: 10/612,070

(22) Filed: Jul. 3, 2003

(65) Prior Publication Data

US 2004/0017455 A1 Jan. 29, 2004

(30) Foreign Application Priority Data

Jul. 5, 2002 (NL) ..... 1021010

(51) Int. Cl.[7] ..... B41J 2/01
(52) U.S. Cl. ..... 347/103; 347/99; 347/88
(58) Field of Search ..... 347/103, 101, 347/105, 88, 85, 99; 428/195, 212

(56) References Cited

U.S. PATENT DOCUMENTS 5,372,852 A 12/1994 Titterington et al.
6,386,697 B1 * 5/2002 Yamamoto et al. ..... 347/103
6,390,617 B1 5/2002 Iwao
6,843,559 B2 * 1/2005 Pan et al. ..... 347/103

FOREIGN PATENT DOCUMENTS

EP 0 443 628 A2 8/1991
EP 0 938 975 A2 9/1999
EP 938975 A2 * 9/1999 ..... B41J/2/01
EP 1 022 140 A1 7/2000

* cited by examiner

*Primary Examiner*—Manish Shah
(74) *Attorney, Agent, or Firm*—Birch, Stewart, Kolasch & Birch, LLP

(57) ABSTRACT

A method of printing a receiving material with hot melt ink using an intermediate element having a surface containing an elastomer with a surface tension in which the polar part thereof is less than or equal to 20 mN/m, wherein the receiving material is brought into contact with the intermediate element in such manner that the ink transfers from the intermediate element to the receiving material, and wherein the elastomer has a hardness of less than 80 Shore A, a thermal conductivity coefficient greater than 0.15 W/mK, and in absorption of less than 10%, and a tanδ of less than 0.3.

8 Claims, 4 Drawing Sheets

METHOD OF PRINTING A RECEIVING MATERIAL WITH HOT MELT INK AND AN INKJET PRINTER SUITABLE FOR APPLYING SUCH A METHOD

BACKGROUND OF THE INVENTION

This non-provisional application claims priority under 35 U.S.C. § 119(a) on Patent Application No. 1021010 filed in The Netherlands on July Jul. 5, 2002, which is herein incorporated by reference.

1. Field of the Invention

The present invention relates to a method of printing a receiving material with hot melt ink which includes the steps of heating the ink to above a temperature at which it is liquid, imagewise transferring the liquid ink to an intermediate element using an inkjet printhead, the intermediate element having a surface containing an elastomer with a surface tension having a polar part equal to or less than 20 mN/m, and bringing the receiving material into contact with the intermediate element in such a manner that the ink transfers from the intermediate element to the receiving material. The present invention also relates to an inkjet printer suitable for applying the present method, the combination of such a printer with an ink pre-eminently suitable for such a purpose, and a method of selecting an elastomer suitable for use in such a method.

2. Related Art

General methods and printers of this type are known from U.S. Pat. No. 5,372,852. In this method, hot melt ink, i.e. an ink which is solid at room temperature but liquid at elevated temperature, is applied to the receiving material via an indirect process. For this purpose, the ink is first heated in the inkjet printhead to a temperature at which it is liquid, i.e. has a consistency such that it can be ejected in the form of small drops by means of an inkjet printhead. Printheads of this kind are well known, for example from EP 0 443 628 or EP 1 022 140. The ink drops are ejected image-wise onto a liquid intermediate surface, particularly a surface of silicone oil, present in the form of a thin layer on the surface of the intermediate element. Since the temperature of the intermediate element is much lower than that at which the ink is liquid, the ink solidifies on the intermediate element and passes into a solid but malleable state which makes the ink pressure-transferable. The ink is then brought into contact with the receiving material in a transfer nip, which is formed at the interface of the intermediate element and a pressure roller in contact therewith. As a result of the high pressure at the transfer nip, typically 750–850 p.s.i. (52–59 bar) the solidified ink is transferred from the intermediate element to the receiving material and forms a connection with that material. After further cooling to room temperature, the ink finally sits solidly on the receiving material and is reasonably resistant to mechanical action such as folding and scratching. In this known method, which is incidentally also described in U.S. Pat. No. 5,389,958, U.S. Pat. No. 5,614,933 and U.S. Pat. No. 5,777,650, it has been found very important that the surface of the intermediate element should be sufficiently rigid and hard to enable the ink present on its surface to be able to deform when the receiving material passes through the transfer nip. If the pressure is too low, the transfer yield is insufficient, resulting in poor image quality and soiling of the intermediate element with non-transferred ink. Accordingly, in the known method, a surface of anodised aluminium, which is a rigid and hard material, is preferably used, so that a high nip pressure can be achieved.

It is described that elastomers such as silicone rubber, fluorosilicone rubber and Teflon can also be used. It is well known that materials of this kind generally have a low surface tension, typically lower than 50 mN/m and are mainly built up from a-polar interactions, so that these materials have relatively good release properties. It is also described that these elastomers, if they are to function in the indirect inkjet process, must satisfy the same mechanical requirements, i.e. have a rigidity and hardness comparable to that of anodised aluminium.

The known method has a number of disadvantages. Since it is necessary to obtain a high nip pressure, the intermediate element is constructed in the form of a rigid drum with a hard surface. A drum of this kind is not only expensive to produce, but also occupies relatively considerable space (as a result of the relatively large fixed diameter), particularly when it is required to use larger receiving material formats. It is very disadvantageous that this drum must be mechanically very rigidly suspended so that the really high pressures can be achieved. A suspension of this kind is expensive. Moreover, no matter how rigid the drum is, it will always sag in the middle to some extent, resulting in poor transfer. This can be obviated by making even more rigid drums or drums, for example, of different form, for example with curved surfaces, but this results in even higher production costs. As a result, the length of the drum is limited to about 13"(about 33 cm) for economically viable applications. As a result, receiving materials wider than about 12½" cannot be printed. Another disadvantage of the use of a rigid intermediate element is noticeable when the receiving material enters the transfer nip. Despite the fact that the receiving material always has a low weight, the momentum of this material is relatively considerable due to its high speed. As a result, an entry of this kind has a noticeable impact on the drum and the pressure roller together forming the nip. This impact results in a short disturbance in the rotation of the drum and this is also perceptible at the inkjet printhead because of the high rigidity of this drum. As a result, registration errors may arise and, accordingly, the printed image may be distorted.

Another important disadvantage of the known method is that a thin layer of oil has to be applied to the intermediate element. This oil is required to enable the ink to be transferred. Without oil, the ink will hardly be transferred, if at all, to the receiving material but will adhere firmly to the intermediate element. A metering station is necessary to meter a thin layer of oil. This again increases the production costs of the printer. Furthermore, a layer of oil of this kind results in soiling of the receiving material and the printer interior. The receiving materials may as a result have a spotted impression and the printer may ultimately soil, creating a negative effect on its operation. Such soiling leads to extra maintenance costs. Another disadvantage of the use of oil is that it has to be repeatedly replaced, thus adversely affecting printer productivity.

SUMMARY OF THE INVENTION

The object of the present invention is to obviate the above disadvantages. To this end, a printing method has been developed which utilizes an intermediate element provided with an elastomeric surface having a hardness of less than 80 Shore A, e.g., a Shore A hardness of greater than 0 to less than 80, a thermal conductivity coefficient greater than 0.15 W/mK, an ink absorption of less than 10%, and a tanδ of less than 0.3. It has surprisingly been realised that an elastomer with a sufficiently low hardness can also result in a suitable method, i.e. a method in which the transfer yield is high and the adhesion to the receiving material is sufficiently strong, provided the thermal conductivity coefficient, the ink absorption and the tanδ satisfy the above relationships. It has been unexpectedly found that when an elastomer is used with the criteria of the present invention, despite the relatively low nip pressure which can be achieved therewith (typically 1–10 bar), a transfer yield of 100% can nevertheless be achieved with the ink adhering satisfactorily to the receiving material. The reason for this is not completely clear but it is perhaps the favorable result of the low nip pressure that the ink also adheres less strongly to the surface of the intermediate element, so that less forces are needed to be overcome to be able to transfer the ink. However, this on its own cannot explain the entire invention, because too low a thermal conductivity coefficient in turn results in a noticeable decline in the transfer yield. If the thermal conductivity is too low, ink drops often appear to split in the transfer nip (cohesive failure) so that the transfer is similar to a stamping process with an associated low transfer yield. In the case of a soft elastomer, too high an ink absorption also results in a noticeable decline in the transfer yield. The low yield cannot be explained by ink remaining in the elastomer, often a few percent maximum in the printing process, but here again appears to be dominated by an incomplete transfer, i.e. ink drops which do not transfer or which only partially transfer. Finally, in the case of a soft elastomer, the tanδ of the elastomer appears to be significant. If this value is increased above the limit of the present invention, the transfer yield noticeably declines. The reason for this is not clear but it is possibly associated with the fact that such an elastomer will undergo permanent deformation more easily.

One of the advantageous features of the present invention is that it is possible to dispense with a rigid and hard intermediate element because it is no longer necessary to generate high pressures in the transfer nip. Abandoning high pressures means that it is possible to use a simple mechanical suspension for the intermediate element. Since the latter is no longer subjected to such high pressures, it is possible to use a much wider intermediate element, for example up to widths equal to those of the current large-format receiving materials (A3, A2 etc). At the same time, the intermediate element can be made much lighter, for example in the form of a relatively weak drum with a layer of elastomer thereon. This layer of elastomer also has the advantage that the momentum of a receiving sheet entering the transfer nip will be transmitted to a lesser degree over the periphery of the intermediate element, because the momentum can to a not inconsiderable extent be taken in the elastomer around the nip. An additional advantage of the use of an elastomer as a surface for the intermediate element is that the transfer nip can be formed by two intermediate elements between which the receiving material is fed. This makes it possible, in principle, for both surfaces of the receiving material to be printed simultaneously, resulting in high productivity. This is impossible in the known method because the hardness of the surface of each of the intermediate elements would make it impossible to form a uniform nip when two such elements together form the transfer nip.

The present invention also makes it possible to construct the intermediate element in the form of a belt. This has the advantage that a more compact print engine can be made because a belt can easily be trained around rollers in order to obtain a compact belt run. In addition, in the case of an intermediate element constructed as a belt, for example a perfluoropolyether rubber applied to a film, the impact of a sheet of receiving material in the transfer nip can be taken better because of the high deformability of the intermediate element over its entire length. Another advantage of a belt is that the exit angle at which the sheet of receiving material leaves the transfer nip can readily be adapted, for example by running the intermediate element in the transfer nip over a roller of a different diameter. Such an adaptation may be necessary to improve the sheet separation, i.e. releasing the sheet of receiving material from the intermediate element and the pressure roller when the sheet leaves the transfer nip. Also, the invention is not restricted to transfer elements consisting entirely of an elastomer. It is also possible to provide just the top layer of the transfer element with a layer of elastomer as specified by the method of the present invention. The carrier of this top layer may be any arbitrary material, for example a rubber which is in turn applied to a solid support such as a film or a fabric, or a metal or plastic carrier etc. which may or may not be rubberised.

The present invention provides more freedom in the choice of inks. This is important because the ink already has to meet many requirements: it must be capable of processing in an inkjet printhead, it must be able to enter into sufficient interaction with the receiving material, it must harden sufficiently rapidly after cooling (so that a printed receiving material can be rapidly subjected to mechanical load, for example by using it as an input to another printer) and it must be durable so that printed images do not spoil in the course of time.

The surface of the intermediate element denotes that part on the outside of the intermediate element which has an appreciable influence on the transfer process. Thus a rubber top layer provided with a mono-layer of vapor-coated material will always be considered as the surface of the intermediate element despite the fact that the real surface is formed by the mono-layer vapour-coated material. The surface of the intermediate element contains an elastomer having a surface tension in which the polar part thereof is 20 mN/m or less.

In one embodiment, use is made of an elastomer, for example, a silicon elastomer such as polyorganosiloxane, of which the polar part of the surface tension is equal to or less than 10 mN/m, the elastomer has a hardness of between 20 and 60 Shore A, a thermal conductivity coefficient of between 0.15 and 1 W/mK, an ink absorption of less than 6%, and a tanδ of between 0.01 and 0.25. The elastomers of this embodiment result in a method which provide an even greater freedom of design because the hardness of the elastomer is lower. This lower hardness, which in principle might give rise to a lower transfer yield, is surprisingly compensated by a smaller polar part of the surface tension, a higher thermal conductivity coefficient, a lower ink absorption and a tanδ between specific limits. In this embodiment, a hardness of less than 20 Shore A has been found to give a less satisfactory transfer yield. A thermal conductivity coefficient greater than 1 W/mK also results in a less than satisfactory transfer yield in this embodiment, for reasons which are still unclear. An elastomer suitable for use in the method according to this embodiment is very suitable for use in an inkjet printer in which ink is transferred to a receiving material via an intermediate element.

In a further embodiment, use is made of an elastomer, for example, a fluorosilicon elastomer such as polyorganofluorosiloxane, in which the polar part of the surface tension is equal to or less than 5 mN/m, an elastomer which has a hardness of between 25 and 55 Shore A, a thermal conductivity coefficient of between 0.18 and 0.6 W/mK, an ink absorption of less than 4%, and a tanδ of between 0.01 and 0.2. It has been surprisingly found that this embodiment can even provide a further improvement in the printing properties, particularly the transfer yield, possibly because of a further optimization of the elastomeric properties. An elastomer suitable for use in the method according to this embodiment is pre-eminently suitable for use in an inkjet printer in which ink is transferred to a receiving material via an intermediate element.

In a further embodiment of the present invention, the elastomer is selected from the group consisting of silicone rubber, fluorosilicone rubber and perfluoropolyether rubber. Elastomers of this kind are well-known in the art. These materials have a low surface tension, so that they often have intrinsically good release properties. It has been found possible to obtain elastomers of each of these types which meet the requirements for use in a method of the present invention. Also, these rubbers can be obtained in thermally stable forms, making them pre-eminently suitable for use in the present method.

In a further embodiment of the present invention, the ink used has a deformation energy of less than $20\times10^5$ Pa.s at a top limit in the temperature at which the ink is pressure-transferable, e.g., greater than 0 to less than $20\times10^5$ Pa.s. It has been found that such inks in combination with the present method result in a printing process with a very good transfer yield of up to 100% and a good image quality. The present invention also relates to the combination of such an ink and a printer suitable for applying the present method. It has been surprisingly found that this combination results in very good print results despite the fact that the printer contains an intermediate element having a surface of a relatively soft elastomer.

The invention also relates to a method of selecting the desired elastomer which comprises determining the polar part of the surface tension of the elastomer, determining the hardness of the elastomer, determining the thermal conductivity coefficient of the elastomer, determining the ink absorption of the elastomer, and determining the tanδ of the elastomer, wherein the elastomer is selected if the polar part of the surface tension is equal to or less than 20 mN/m, the hardness is less than 80 Shore A, the thermal conductivity coefficient is greater than 0.15 W/mK, the ink absorption is less than 10%, and the tanδ is less than 0.3. In the present method, determining each of the parameters comprises measuring the parameters, particularly in the ways described in the examples. However, such determinations can be carried out in any desired manner. For example, it would be possible to determine a parameter by estimating it: if, for example, it is clear that the raw materials used possess that parameters that in every case face within the limits defined by the present invention. Thus a silicone rubber made in a correct manner will have a polar part of the surface tension between 0.1 and 4 mN/m. A more accurate determination of this polar part is unnecessary in the light of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
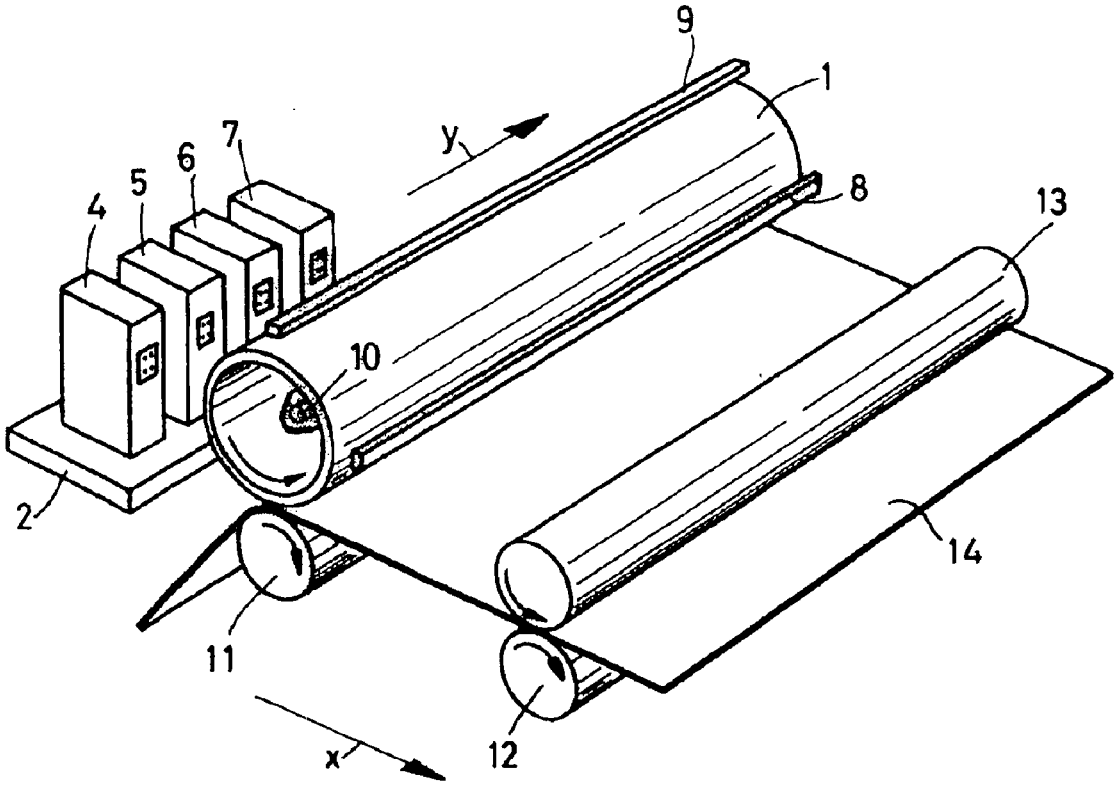
FIG. 1 diagrammatically illustrates an inkjet printer according to the present invention.

The following Examples are provided as being merely exemplary of the present invention, and thus should not be considered as a limitation thereof.

EXAMPLE 1

Example 1 shows how the surface tension of an elastomer can be measured and determined.

Elastomers usable in the method according to the invention have a surface tension in which the polar part is equal to or less than 20 mN/m. This can be determined by measuring on a number of different liquids the edge angle that these liquids make with the surface of the elastomer. On this basis it is possible to calculate the total surface tension and the polar part thereof. This method is well known in the art and is described inter alia in J. Adhesion Sci. Technol. Vol. 6, No. 12, pp. 1269–1302 (1992): Contact angle, wetting, and adhesion, a critical review (Robert J. Good).

This method can be performed semi-automatically on the VCA2500XE made by AST products. Prior to the measurement, the surface for measuring should be cleaned so that it is representative of the surface of the actual elastomer, for example by first blowing it with air (which should be oil-free), and then cleaning it with a mild volatile liquid, for example ethanol, and stabilising the sample for some hours in a clean environment under normal conditions (20° C., air pressure 1 bar, 50% relative air humidity). The edge angle formed by the liquids water, di-iodomethane and formamide with the surface are then measured under the same conditions by the method specified with the VCA2500XE. In this case the surface tension is determined using a receding drop of liquid, known as the receding angle. It is important that none of the liquids used should be absorbed by or reacted with the elastomer. If that should happen, another liquid will have to be selected. In principle this has no influence on the final determined value of the polar part of the surface tension. The total surface tension and the disperse and polar part is calculated from the edge angle measurements. Various models can be used for this calculation. Elastomers suitable for use in the method according to the present invention have a polar part of the surface tension equal to or less than 20 mN/m, calculated by the geometric mean model. It has been found that a polar part greater than 20 mN/m often results in an incomplete transfer of the ink from the intermediate element to the receiving material.

EXAMPLE 2

The hardness in Shore A can be determined as described in ASTM Standard D 2240 of 1991.

EXAMPLE 3

Example 3 indicates how the thermal conductivity coefficient of an elastomer can be determined. The thermal conductivity is a measure of the heat flow through a material of a specific thickness as a result of a specific temperature difference over the material. This thermal conductivity can be measured using the Holometrix c-matic TCA 200. A sample of the material under investigation is made prior to the measurement. This sample is round with a diameter of 50 to 52 mm and has a thickness of between 6 and 12 mm. For a reliable measurement, the sample must have plain-parallelism such that there are no thickness differences of more than 0.1 mm. For an accurate determination of the thermal conductivity, the thickness of the sample must be known with an accuracy of 0.05 mm. For this purpose the thickness meter such as the Peacock model H can be used.

To obtain good contact between the sample and the two heat transmission plates of the TCA 200 the sample is provided with a thin layer of thermally conductive paste on both sides, for example Silicone Heat Sink Compound type DC 340. The thickness of this layer has practically no influence on the measurement if the thermal conductivity of the sample is much less than that of the paste. Since the measured value is dependent on the type of apparatus, the sample geometry and the layer of thermally conductive paste, a calibration is first carried out with two samples having a known thermal conductivity. An average sample temperature of 100° C. is chosen for the measurement of elastomers. For this purpose, the following settings are selected on the TCA 200: <Upper face>400; <Guard>410; <Lower face>420. These values correspond to a temperature difference of about 20° C. (110°-90° C.) between the top and bottom plates.

Elastomers having a thermal conductivity greater than 0.15 W/mK are usable in the method according to the present invention. The transfer is often poor in the case of a lower thermal conductivity. This poor transfer is manifested, for example, as an uneven transfer, i.e. the transfer is adequate (up to 100%) in some places and far below 90% in others. With deteriorating thermal conductivity, the transfer declines overall and splitting of the ink particularly occurs.

EXAMPLE 4

This example indicates how the ink absorption of an elastomer can be determined. For this purpose, a sample of the elastomer for measurement is used with a thickness of about 2 mm and a surface area (in elevation) of 5.4 $cm^2$. This sample is immersed in the relevant ink, which is maintained at 10° C. above its melting temperature. The relative increase in weight of the sample over time is determined by removing the sample from the ink at specific times, cleaning the surface and weighing the sample. As soon as there is no further weight increase (typically after 10–100 hours) the test is concluded. The final relative weight increase in percent is termed the ink absorption.

It has been found that elastomers usable in the method according to the present invention have an ink absorption lower than 10%. At higher ink absorption the transfer yield at the top limit (see Example 6 for the definition of the top limit) decreases noticeably and a relatively considerable amount of ink remains on the intermediate element. This is disadvantageous for the print quality and makes it necessary for the intermediate element to be regularly cleaned. In a preferred embodiment, the ink absorption is between 1 and 5%. It has been found that the influence on printing is then minimal. For the determination of the ink absorption it is also necessary for the ink to be used as it will finally be printed with the inkjet printer. It is in fact this ink which must finally be transferred from the intermediate element to the receiving material. This also means that the elastomer may absorb (much) more intensively than 10%, inks which are not printed by the present method, for example if they have too low a melting point, are not pressure-transferable, or for some other reason.

EXAMPLE 5

This example indicates how it is possible to determine the tanδ of an elastomer. The tanδ of a material is the ratio between the viscous deformation of the material and the elastic deformation thereof. The higher this ratio, the more the energy that this material will dissipate at an applied deformation and be permanently deformed more intensively.

The tanδ can be determined by means of a rheometer, for example the Rheometrics (RSA II) Solid Analyzer II. The principle of the measurement is that a specific deformation is applied to a sample of the material under investigation, the force response to the deformation being measured. In the case of a completely elastic material, this response will be in phase with the applied deformation. The phase shift δ is than equal to 0, so that tanδ (the tangent of the angle δ) is also equal to 0. As soon as the material also deforms viscously, there will be a phase shift δ between the deformation and the response. The tanδ can easily be determined therefrom. To measure an elastomer for use in the method according to the present invention, a sample about 1 mm thick is made, the sample having a width of about 5 mm and a length of about 40 mm. This length is necessary to enable the sample to be clamped in the RSA II. Prior to the measurement, the measuring environment and the sample are brought, using the oven as provided with an RSA II, to a temperature equal to the temperature at which the elastomer will be used in the printer. In other words, the measuring temperature is chosen to be equal to the temperature that the elastomer will finally have in the application according to this invention. This temperature is typically between 60° C. and 80° C. The sample is measured by exposing it to a linear (as opposed to shearing) elongation (as against compression). For the measurement itself see the Operators Manual of the RSA II. It should be noted that measurements are typically taken under the following conditions: a Timesweep at a frequency of 40 rad/sec, a 1% strain, a temperature of 70° C., a total time of 120 sec and a Time per Measurement of 6 sec. Setting options for a typical measurement are: Mode=Static force tracking dynamic force, Direction=Tension, Maximum applied strain=1.8% and Strain Adjustment=100%. During the measurement the deformation and response signals are tracked on an oscilloscope. In this way it is possible to check whether the signals are sinusoidal. Only then is the measurement reliable. The measurement is carried out by measuring the tanδ of at least two samples of the same elastomer and averaging the result.

It has been found that elastomers having a tanδ greater than 0.3 are not usable in the method according to the present invention. In the course of time, elastomers of this kind result in a poor transfer which manifests itself, for example, in an uneven transfer of the ink. It would appear than an uneven nip pressure is the cause of this problem.

EXAMPLE 6

This example indicates how the deformation energy of an ink can be determined at a temperature at which the ink is pressure-transferable. First of all it is necessary to determine whether the ink is pressure-transferable. It is not possible to predict beforehand whether a specific meltable ink is pressure-transferable. Analytical methods for determining whether a specific ink is pressure-transferable are known from the literature, for example U.S. Pat. No. 5,372,852 and the Journal of Imaging Science and Technology, Vol. 40, No. 5, September/October 1996, pages 386–389. Alternatively, a specific ink can be subjected to a practical test. For this purpose it is possible to use a print rig which uses an indirect inkjet process as the method. In this example, use is made of a printer that is generally available, namely the Xerox Phaser 840 printer. The relevant ink is loaded into the inkjet printhead of this printer and printing is then carried out. It is also possible to use a different printhead for applying the ink to the transfer element, for example a printhead specially designed to use the ink under test. In principle, any method of applying a thin layer of ink (typically 10–100 $\mu$m) to the transfer element can be used.

To determine the pressure-transferability, the ink must be transferred at different temperatures from the transfer element to a receiving material. In a first measurement, the transfer element is set to a temperature far above the ink melting temperature. Hot melt inks typically melt at 40–80° C., so that an initial temperature of 100° C. will normally be sufficient. It is then necessary to determine what the transfer yield is in the case of a single transfer (single contact between each ink drop on the transfer element and the receiving material). This determination is explained in detail hereinafter. If the ink is not pressure-transferable at this temperature, there will in fact be a stamping process with a low transfer yield, for example 5 to 10%. The temperature of the transfer element must then be reduced, for example by 5° C. The transfer yield will then be re-determined. Thereafter the temperature of the transfer element can again be reduced by 5° C. in order to make a new print and determine the transfer yield. In this way it is possible to investigate the entire temperature range to room temperature. If there is a temperature range where the transfer yield is higher than 90%, then the ink is said to be pressure-transferable.

The deformation energy itself is measured at the highest temperature at which the ink is still just pressure-transferable, i.e. has a transfer yield of just 90%. This top limit as it is known can be determined by repeating the above-described measurement around the temperature range where the 90% yield is found, using a number of relatively small steps in the temperature, for example steps of 1 or ½° C.

The transfer yield is defined as the optical density of a printed image in the case of a single transfer (i.e. the receiving material has been in contact with the image on the transfer element only once), divided by the optical density in the case of a 100% transfer:

$$\eta_T=(OD)_{T,1}/(OD)_{100\%} \quad (1)$$

where $\eta_T$ is the transfer yield at a temperature T of the transfer element, $(OD)_{T,1}$ is the optical density of a single transfer at a temperature T of the transfer element and $(OD)_{100\%}$ is the optical density in the case of a 100% transfer. $(OD)_{T,1}$ is measured with a Gretag densitometer (Gretag D183 OD-meter) by measuring the optical density of the image as transferred to a receiving material at a temperature T of the transfer element. $(OD)_{100\%}$ is a theoretical value which for most inks will not be achieved in a single transfer at a specific T. However, this value can also be determined if the transfer is not complete, for example 20% in one step. In that case, a residual image of 80% will remain on the transfer element. By carrying out a subsequent transfer with this transfer element, part of the ink will again be transferred to a new sheet of receiving material introduced. For this purpose it is necessary for the residual image not to be removed from the transfer element after the first transfer step. For this purpose, the cleaners and the like must be temporarily rendered inoperative. By carrying out transfer so often that no more ink is found on the transfer element, the image as was initially printed on the transfer element will be transferred in a number of steps (1, 2, 3 . . . n) to the same number of sheets of receiving material (sheet 1, sheet 2, sheet 3, . . . sheet n). By adding the optical densities of each of the sheets 1 to n the value for $(OD)_{100\%}$ is obtained.

$$(OD)_{100\%}=(OD)_1+(OD)_2+(OD)_3+\ldots+(OD)_n \quad (2)$$

In principle, the temperature at which the transfer element $(OD)_{100\%}$ is determined can be selected freely, but the determination is all the more accurate the smaller the number of sheets required to achieve 100% transfer. Thus $(OD)_{100\%}$ is preferably determined in the temperature range in which the ink is pressure-transferable. Preferably again, $(OD)_{100\%}$ is determined at the same temperature as the temperature at which the transfer yield $\eta_T$ is determined.

By combining formula (1) and (2) the transfer yield can be determined at any arbitrary temperature T of the transfer element:

$$\eta_T=(OD)_{T,1}/((OD)_1+(OD)_2+(OD)_3+\ldots+(OD)_n) \quad (3)$$

to determine the deformation energy at the top limit temperature there are a number of possibilities of which two will be given in this example. The two specifications differ in the method in which the sample of the ink for measurement is brought to the measuring temperature. The first specification is relatively simple. In this case the sample is heated from the solid state (room temperature) to the measuring temperature. This simple determination, however, can only be used if the state that the ink reaches by heating from the solid state to the measuring temperature is equal to the state achieved if the ink is cooled from the melted state to said temperature (this being the practical situation during printing). If this is not the case, the second specification must be used, in which the sample, just as in practical printing, is cooled from the melt to the measuring temperature. Moreover, this latter specification can be used for any type of ink.

The first specification can be used, for example, for inks which contain only one crystalline thinner, which thinner, on heating up, melts only at a temperature above the measuring temperature and which thinner on cooling has already crystallized at a temperature above the measuring temperature. It is clear that insofar as concerns the state at the measuring temperature it is immaterial whether the ink is heated from room temperature or is cooled from a high temperature. Such a position of melting and solidification peaks can easily be determined using differential scanning calorimetry at standard cooling rates of 20° C./min as sufficiently known in the art. The second possibility of measuring the deformation energy of an ink at the top limit can be used for any type of ink.

Figure 2:
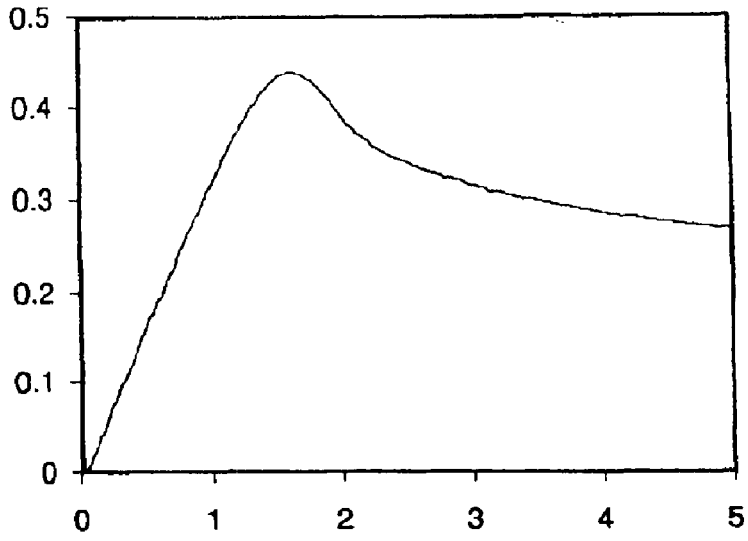
FIG. 2 shows a graph of stress versus time for the deformation of an ink at the maximum temperature limit at which the ink is still pressure-transferable.

The first possibility of measuring the deformation energy (this is really not the correct term because this "energy" is not given in Joules but in Pascal second) takes place using a rheometer, for example the RSA II (Rheometrics). For this purpose, a solid ink film is first made with a thickness of about 2.5 mm. For this purpose, a quantity of ink is melted and poured in the liquid state over a silicone rubber surface with an upright edge so that an ink film forms with a thickness of about 2.5 mm. The ink is then allowed to solidify. A pellet having a cross-section of 4.15 mm is then punched out of the solidified film with a corkscrew. This pellet is transferred to between the two flat plates of the rheometer, which plates have a diameter of about 1 cm. On both sides the plates are brought into contact with the pellet (it is important that the two surfaces of the pellet are as parallel as possible to the rheometer plates). The entire rig, or at least the plates including the pellet, is heated by means of an oven to the top temperature at which the ink is pressure-transferable. The oven and the plates have already been brought to the required temperature under stable conditions before the sample is placed between the plates. As soon as the top temperature has been reached, it is maintained for at least 15 minutes in order to stabilise the temperature of the rig. The pellet is then compressed between the plates at a rate of 4% per second until there is at least a deformation of 20%. During the deformation, the force is measured which is required to apply the deformation. The required stress can be calculated from this force (=force divided by the area of the pellet). The curve showing the required stress against the time can be used to determine the deformation energy. A curve of this kind is shown in FIG. 2, where the applied stress in MPa ($10^6$Pa) has been plotted on the y-axis against the time in seconds on the x-axis. The deformation energy associated with a 20% deformation, which is reached after 5 seconds in this measurement, is calculated by determining the area beneath the curve.

The reproducibility of this measurement depends on a number of factors, the most important being the sample preparation. If a pellet is not homogeneous or if the two surfaces of the pellet are not plane-parallel, this will result in deviations in the measured deformation energy with respect to the actual value. A-systematic deviations can be eliminated by performing the measurement frequently and averaging the measured values. In this way, an accurate determination can be carried out.

The second possibility is a method in which the inks are measured from the melted state. In this measurement, the ink is cooled from the liquid state, at a temperature equal for example to the jetting temperature, to a temperature equal to the top limit at which the ink is pressure-transferable. At this temperature the ink is stabilised until—as in the case of the stabilisation described in possibility 1—both the ink and the apparatus are in equilibrium. Before an ink is subjected to this measurement, it may be necessary to check, by means of a DSC measurement, whether an ink cooled in this way and maintained at the top limit temperature for the time required to carry out the measurement with the RSA (some 20 minutes in all) remains stable. If an ink were to partially crystallise, for example, in the said time interval, the measurement on the RSA would not be representative of practice in which the ink, after cooling on the transfer element, is transferred practically immediately to the receiving material and hence has no chance to crystallise at the top limit. In such a case, the RSA measurement must be accelerated and may at most occupy the time in which the ink remains stable. This can be optimised, for example, by the temperature stabilisation.

Figure 3:
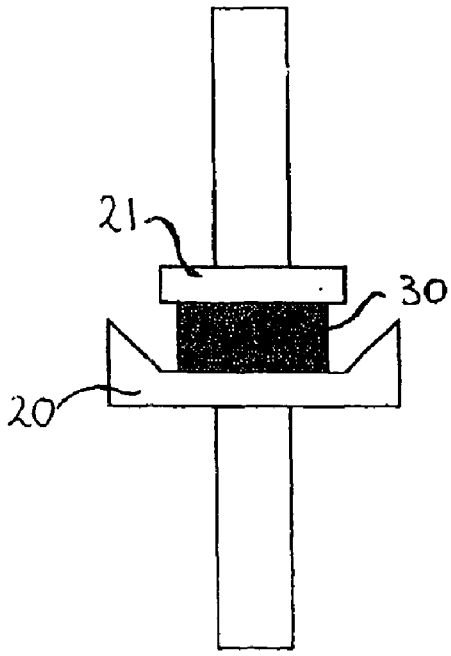
FIG. 3 shows a bottom plate and top plate suitable for measuring the deformation energy of an ink having at least two crystallization peaks.

To enable the ink to be measured from the liquid state, a bottom plate has been developed for the RSA and is shown diagrammatically in FIG. 3. Like the top plate, this round bottom plate has a flat part with a diameter of 5.0 mm but an obliquely sloping edge so that liquid ink can be maintained on the bottom plate. The determination starts by weighing a quantity of ink such that said ink in the melted state occupies a volume of about 20 $mm^3$. This ink is transferred to the bottom plate 20 of the RSA. The ink is then melted at 120° C., so that it assumes a drop form (not shown). The top plate 21, which is also at a temperature of 120° C., is then brought above the bottom plate to a height of 1 mm, the top plate being situated exactly above the flat part of the bottom plate. As a result, the ink 30 will form a cylindrical column between the two plates as shown in FIG. 3. If this column does not form automatically, the top plate can first be brought closer to the bottom plate, for example to a distance of 0.5 mm, until contact is made with the liquid ink, whereafter the distance is again increased to 1 mm. The ink is then cooled in about three steps to the measuring temperature (i.e. the top limit at which the ink is pressure-transferable). After each step, the ink is stabilised for about 5 minutes at the relevant temperature. In order to prevent stress in the ink as a result of shrinkage of the ink and shrinkage of the top and bottom plates, the force is automatically kept at zero (the distance between the plates being reduced for this purpose). As soon as the measuring temperature is reached, and the rig is sufficiently stabilised, a situation occurs which corresponds to the practical situation, i.e. a drop of liquid ink which cools from a high temperature to the top limit. The actual measurement can then start. For this purpose, the cylindrical ink column is compressed at a rate of 4% per second until a 20% deformation is reached. The deformation energy for 20% deformation can be readily derived from this as shown above in connection with FIG. 2.

With the RSA measurements it is possible to measure deformation energies up to $25\times10^5$ Pa.s. The inks known in the prior art, however, often have a deformation energy outside that range. In order to enable the deformation thereof also to be determined, use must made of a less sensitive apparatus, for example a dynamic tension bench such as the MTS 831 Elastomer Test System (MTS Systems Corporation). In this apparatus, in a comparable manner to that indicated above but with ink pellets of larger dimensions, typically 9.5 mm cross-section and 8 mm height, it is possible to apply deformations at an elevated temperature, from which it is possible to determine from the measured stress required the deformation energy in Pa.s for 20% deformation of the pellet. The spread in this measurement is relatively small for deformation energies above the $25\times10^5$ Pa.s, and depends inter alia again on the plane-parallel nature of the top and bottom of the ink pellet.

EXAMPLE 7

Example 7 identifies a number of inks which can be used in the method of the present invention.

This Example gives known inks and inks having a deformation energy lower than $20\times10^5$ Pa.s.

Pressure-transferable inks are known from the prior art, for example U.S. Pat. No. 5,372,852 and U.S. Pat. No. 6,174,937. These inks are marketed by Xerox under the names ColorStix Ink and are supplied for the Phaser 340/350 printers (described in the 852 patent), for Phaser 840 printers (described in the 852 patent) and for Phaser 860 printers (probably the same as inks described in the 937 patent). Inks of this kind have at the top limit a deformation energy which is far above the $20\times0^5$ Pa.s. The deformation energies for these inks are accordingly determined using the MTS 831 as described in Example 6 and are shown in Table 1.

TABLE 1

Deformation energies in Pa · s of inks known from the prior art

| Type of ink | Top limit [° C.] | Deformation energy at top limit [Pa · s] |
|---|---|---|
| ColorStix Ink (Black) Phaser 340/350 | 63 | $40 \times 10^5$ |
| ColorStix Ink (Black) Phaser 840 | 63 | $40 \times 10^5$ |
| ColorStix II Ink (Black) Phaser 860 | 64 | $42 \times 10^5$ |

Table 2 is a diagrammatic enumeration of a number of inks having a low deformation energy, according to one embodiment of the method of the present invention.

Ink 1 is an ink containing 50% binder of the Uratak type, in this case Uratak 68520, a semi-crystalline binder of DSM (Netherlands) and 50% of a crystalline thickener, namely octadecanamide, abbreviated to ODA.

Ink 2, in addition to a small quantity of Uratak, contains 85% of the amorphously solidifying softener pentra-erythritol-tetrabenzoate (PETB) and 10% octadecanamide. Ink 3 contains the same components but then in a different ratio.

Ink 4 contains one-third Künstharz AP, a binder of Hüls, one-third of the amorphously solidifying softener BIPANI, which is the ester of 2,2'-biphenol and methoxybenzoic acid as known from U.S. Pat. No. 6,280,510, and one-third octadecanamide.

Ink 5 contains one-third Uratak, one-third polycyclohex-anone (#468541, Aldrich; case number 9004-41-2) abbreviated to PCH, and one-third octadecanamide.

Ink 6 is practically identical to ink 2 but contains as crystalline thickener gel-4, a compound known under this abbreviation from Table 1 of EP 1 067 157 A1.

Ink 7 also contains a small quantity of Uratak and in addition 66.2% of the amorphously solidifying softener Glypochi which is known from Table 3a, Section H, of EP 1 067 157 A1. The crystalline thickeners that this ink contains are 7.6% n-hexatriacontane (case number 630-06-8) (abbreviated to HTC) and 22.1% Kemamide E, an unsaturated primary amide of Witco.

Ink 8 contains in equal quantities Küinstharz AP, PETB and gel-4.

Ink 9 contains 60% of the crystalline-solidifying softener penta-erythritol-tetrastearate (PETS) and 40% of the crystalline thickener Behenon (22-tritetra-contanon; case number 591-71-9).

Only the meltable fraction, or carrier fraction, is given of the above inks. It should be clear that for practical application dyes and/or pigments are often added to these inks, or other additives such as surfactants, anti-oxidants, UV stabilisers, etc.

All these inks are pressure-transferable and have a deformation energy at the top limit less than $20 \times 10^5$ Pa.s as shown in Table 2. The deformation energies are measured as indicated under Example 6 (possibility 1 using RSA II).

TABLE 2

Inks suitable for use in the method according to the present invention

| Ink | Binder [% by weight] | Softener [% by weight] | Thickener [% by weight] | Top limit [° C.] | Deformation energy [$10^5$ Pa · s] |
|---|---|---|---|---|---|
| 1 | Uratak, 50% | — | ODA, 50% | 75 | 7.2 |
| 2 | Uratak, 5% | PETB, 85% | ODA, 10% | 55 | 0.75 |
| 3 | Uratak, 33.3% | PETB, 33,3% | ODA, 33.3% | 70 | 1.5 |
| 4 | Künstharz AP, 33.3% | BIPANI, 33.3% | ODA, 33.3% | 80 | 1.2 |
| 5 | Uratak, 33.3% | PCH, 33.3% | ODA, 33.3% | 75 | 6.3 |
| 6 | Uratak, 5% | PETB, 85% | gel-4, 10% | 50 | 0.3 |
| 7 | Uratak, 4.1% | Glypochi, 66.2% | HTC, 7.6% en Kemamide E, 22.1% | 45 | 2.4 |
| 8 | Künstharz AP, 33.3% | PETB, 33.3% | gel-4, 33.3% | 85 | 1.1 |
| 9 | — | PETS, 60% | Behenon, 40% | 80 | 3.3 |

EXAMPLE 8

This Example gives print results as attained with known methods and results attained with the method according to the present invention.

Figure 4:
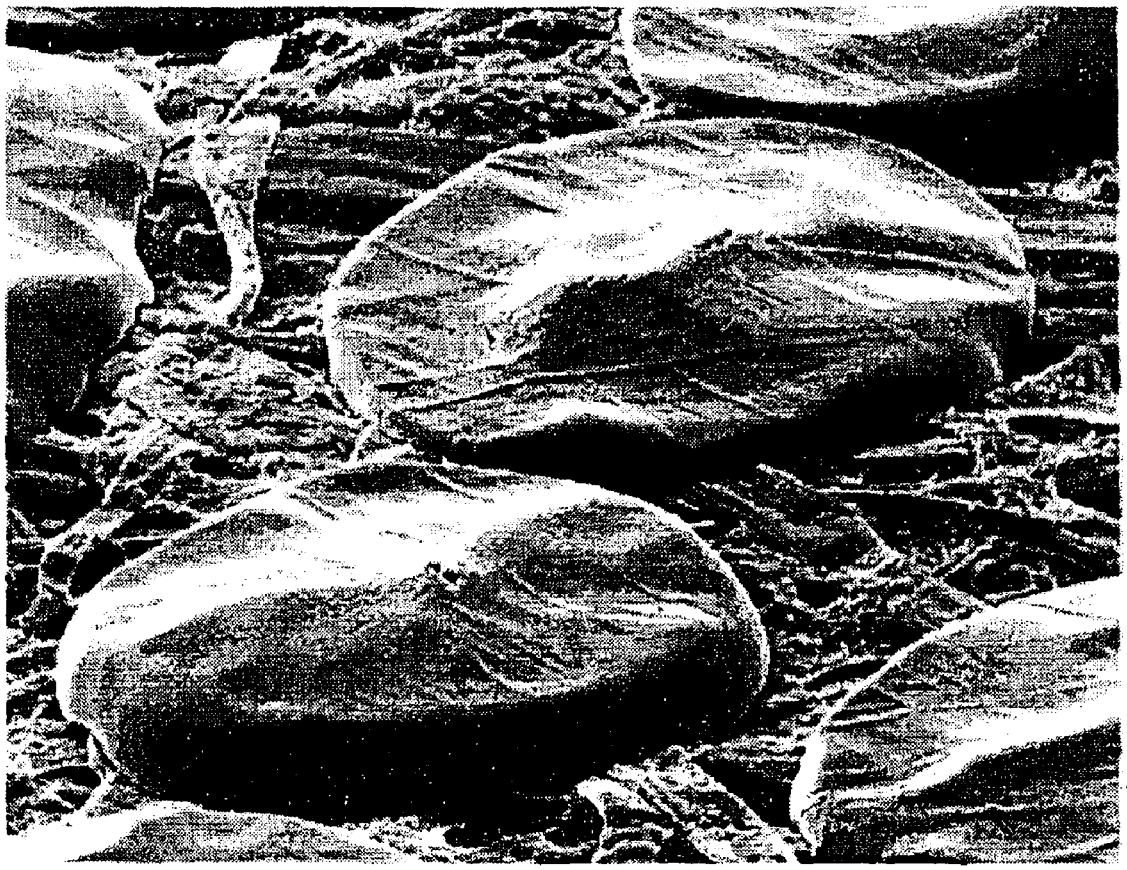
FIG. 4 shows an electron micrograph of an ink printed according to a method known in the art.

FIG. 4 is an SEM photograph of hot melt ink drops after the drops have been transferred to a receiving material and are fused by a cold pressure roller. The impression of the roller is clearly recognisable in the flattened ink drops. This result is attained with a Tektronix (Xerox) Phaser 300 printer. A description of this printer and the method whereby the photograph according to FIG. 4 has been obtained will be found in the Journal of Imaging Science and Technology, Vol. 42, Number 1, January/February 1998.

Figure 5:
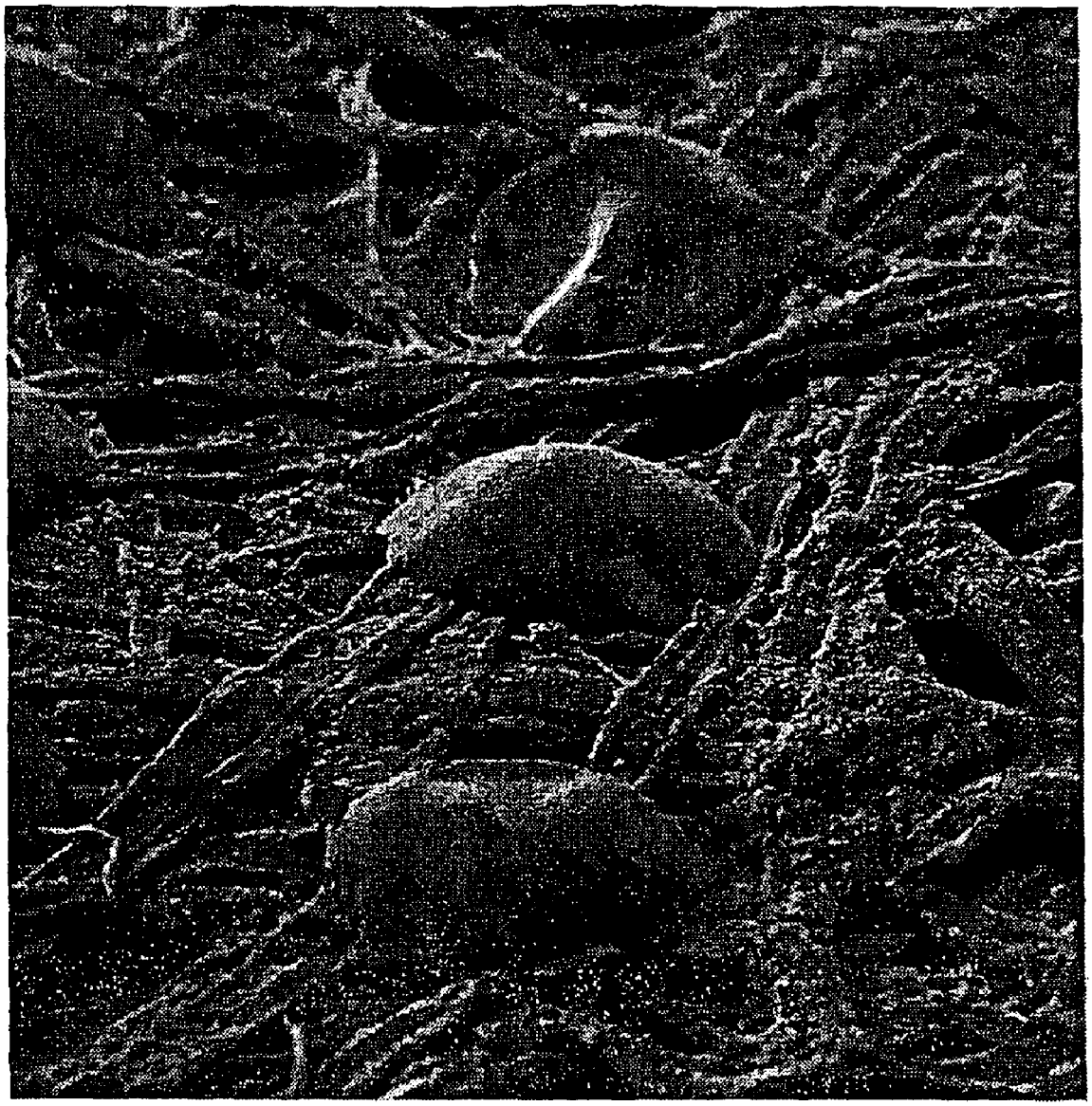
FIG. 5 is an electron micrograph of an ink printed using the method according to the present invention.

FIG. 5 is an SEM photograph of ink drops transferred to a receiving material using the method according to the present invention. To achieve this result, ink number 3 of Table 2 was transferred by means of the inkjet printer as described in connection with FIG. 1 to Océ Red Label paper. In this case the intermediate element is a roller rubberised with approximately 1.5 mm silicone rubber with a hardness of 80 Shore A. Over this there is applied a top layer of a silicone rubber having a hardness of 25 Shore A, a polar part of the surface tension equal to 1 mN/m, an ink absorption of 4%, a tanδ of 0.02 and a thermal conductivity coefficient of 0.235 W/mK. During printing the intermediate element was kept at a temperature of 65° C. and a linear pressure of 3800 N/m was exerted in the fused nip. A printing speed of 50 cm/sec was maintained, equal to a speed of 130 A4 sheets per minute. The SEM photographs were made with an enlargement comparable to that of FIG. 4, i.e. approximately 500 magnification. The electron microscope acceleration voltage used was 15 kV.

It will be seen that despite the use of a very soft rubber as transfer element and the absence of a post-fuse step, the ink drops are fused to the receiving material in a comparable manner to that known in the art. The ink drops are small, sufficiently spread and follow the paper fibers well. The drops have been found to be resistant to mechanical loads such as gumming, scratching and, to a lesser degree, folding.

FIG. 1 is a diagram of an inkjet printer according to the present invention. The intermediate element 1 is the central feature in this method and in this case is a hollow steel roller rubberised with 1.5 mm silicone rubber over which a top layer of 120 $\mu$m silicone rubber is applied. This top layer satisfies the requirements of the present invention. The steel roller is maintained at an elevated temperature by a radiator 10 which selectively heats a specific area of the roller. Using a temperature control system (not shown) the temperature is maintained constant with a margin of some degrees so that the temperature remains within the bottom and top limits at which the ink is pressure-transferable. A typical temperature of the intermediate element is 70° C. The transfer element is provided with elements 8 and 9 disposed a short distance apart and serving as cleaning elements in order to remove any ink residues from the intermediate element. For this purpose, the elements are brought into contact with the surface of the intermediate element.

The printer also comprises a number of printheads 4, 5, 6 and 7, one for each of the colors cyan, magenta, yellow and black, disposed on a carriage 2. The type of printhead does not form part of the present invention and in principle any type of printhead can be used which is suitable for transferring hot melt ink to the transfer element. A printhead of this kind is known, for example, from U.S. Pat. No. 5,757,404. This is a piezo-electric printhead of the drop-on-demand type and is typically used at a temperature of 130° C. and a jetting frequency of 10 kHz. The distance between the front of each of the printheads and the intermediate element is about 1 mm. To generate an image on receiving material 14, the carriage is moved in the indicated direction Y along the surface of the intermediate element and ink is jetted from each of the printheads in the direction of said element. As soon as a strip has been printed in this way on the intermediate element the element is rotated an increment further and a following strip is printed fully by again moving the carriage in the Y direction (but in the opposite direction). In this way an entire image can be built up on the transfer element. As soon as the image or at least a part thereof corresponding to the surface of the intermediate element is ready, a transfer nip is formed by bringing the companion roller 11 into contact, under a specific pressure, typically 3000–4000 N/m, with an intermediate element 1. Companion roller 11 is also a steel roller rubberised with the same layer as the intermediate element. The receiving material 14, particularly a sheet of paper, is then fed through the transfer nip in the direction X by rotating the transfer element and the companion roller in the indicated directions. In this embodiment, the paper is preheated to 70° in the preheating station (not shown). In the transfer nip the image is transferred from the intermediate element to the receiving material. The printed receiving material is fed through a guide comprising soft foam rubber rollers 12 and 13 to a finishing station (not shown).

The present invention is not limited to embodiments in which the image is printed directly by the inkjet printhead on the intermediate element. It is also possible for this to be carried out indirectly, for example using a second intermediate element between the printhead and the first intermediate element. This makes it possible, for example, to print a first image on the first intermediate element (which is printed thereon via the second intermediate element) and then a second image on the second element, whereafter the two images are transferred simultaneously to the receiving material by feeding said material through the nip formed by the first and second intermediate elements.

What is claimed is:

1. A method of printing a receiving material with hot melt ink comprising:

heating the ink to above a temperature at which it is liquid, transferring the liquid ink to an intermediate element, said intermediate element having a surface containing an elastomer, with a surface tension in which the polar part thereof is 20 mN/m or less, bringing the receiving material into contact with the intermediate element in such a manner that the ink transfers from the intermediate element to the receiving material, wherein the elastomer has a hardness less than 80 Shore A, a thermal conductivity coefficient greater than 0.15 W/mK, an ink absorption of less than 10%, and a tanδ of less than 0.3.

2. The method according to claim 1, wherein the polar part of the surface tension is less than or equal to 10 mN/m, and wherein the elastomer has a hardness of between 20 and 60 Shore A, a thermal conductivity coefficient of between 0.15 and 1 W/mK, an ink absorption of less than 6%, and a tanδ of between 0.01 and 0.25.

3. The method according to claim 1, wherein the polar part of the surface tension is less than or equal to 5 mN/m, and wherein the elastomer has a hardness of between 25 and 55 Shore A, a thermal conductivity coefficient of between 0.18 and 0.6 W/mK, an ink absorption of less than 4%, and an tanδ of between 0.01 and 0.2.

4. The method according to claim 1, wherein the elastomer is selected from the group consisting of silicone rubber, fluorosilicone rubber and perfluoropolyether rubber.

5. The method according claim 1, wherein the ink has a deformation energy of less than $20\times10^5$ Pa.s as a top limit in the temperature at which the ink is pressure-transferable.

6. An inkjet printer for printing a receiving material with hot melt ink which comprises, an inkjet printhead suitable for image-wise printing of hot melt ink, an intermediate element for receiving hot melt ink printed by the printhead, said intermediate element having a surface containing an elastomer with a surface tension in which the polar part is equal to or less than 20 mN/m, and means for bringing the receiving material into contact with the intermediate element in order to transfer the ink to the receiving material, wherein the elastomer has a hardness less than 80 Shore A, a thermal conductivity coefficient greater than 0.15 W/mK, an ink absorption of less than 10% and a tanδ of less than 0.3.

7. The inkjet printer according to claim 6, wherein the ink has a deformation energy of less than $20\times10^5$ Pa.s as a top limit in the temperature at which the ink is pressure-transferable.

8. A method of selecting an elastomer suitable for use in a printing method which comprises, determining the polar part of the surface tension of the elastomer, determining the hardness of the elastomer, determining the thermal conductivity coefficient of the elastomer, determining the ink absorption of the elastomer, and determining the tanδ of the elastomer, wherein the elastomer is selected if the polar part of the surface tension is less than or equal to 20 mN/m, the hardness is less than 80 Shore A, the thermal conductivity coefficient is greater than 0.15 W/mK, the ink absorption is less than 10%, and the tanδ is less than 0.3.

* * * * *